US008968616B2

(12) United States Patent
Cioffi

(10) Patent No.: US 8,968,616 B2
(45) Date of Patent: Mar. 3, 2015

(54) METHOD OF PRODUCING A SHELL-PROOF AND BULLET-PROOF STRUCTURE, AND SHELL-PROOF AND BULLET-PROOF STRUCTURE

(76) Inventor: Cosimo Cioffi, Cerreto Guidi-Florence (IT)

( * ) Notice: Subject to any disclaimer, the term of this patent is extended or adjusted under 35 U.S.C. 154(b) by 733 days.

(21) Appl. No.: 13/125,412

(22) PCT Filed: Oct. 28, 2009

(86) PCT No.: PCT/IB2009/007281
§ 371 (c)(1),
(2), (4) Date: May 24, 2011

(87) PCT Pub. No.: WO2010/049802
PCT Pub. Date: May 6, 2010

(65) Prior Publication Data

US 2011/0232470 A1 Sep. 29, 2011

(30) Foreign Application Priority Data

Oct. 29, 2008 (IT) ..... FI2008A0206

(51) Int. Cl.
*B29C 70/02* (2006.01)
*F41H 5/04* (2006.01)

(52) U.S. Cl.
CPC ..... *F41H 5/0464* (2013.01); *F41H 5/0457* (2013.01)
USPC ..... 264/250

(58) Field of Classification Search
USPC ..... 264/255, 328.8
See application file for complete search history.

(56) References Cited

U.S. PATENT DOCUMENTS

| | | | | |
|---|---|---|---|---|
| 6,150,026 | A * | 11/2000 | Furuya et al. | 428/424.8 |
| 6,571,677 | B1 | 6/2003 | Kaura | |
| 6,685,863 | B1 * | 2/2004 | Yabushita et al. | 264/254 |

FOREIGN PATENT DOCUMENTS

| | | | |
|---|---|---|---|
| DE | 43 01 444 | A1 | 7/1994 |
| DE | 199 44 475 | A1 | 4/2000 |
| GB | 108 801 | A | 8/1917 |
| NL | 8403529 | A | 6/1986 |
| WO | 2007/008569 | A | 1/2007 |
| WO | 2008/111925 | A | 9/2008 |

* cited by examiner

*Primary Examiner* — Larry Thrower
*Assistant Examiner* — Xue Liu
(74) *Attorney, Agent, or Firm* — Lucas & Mercanti, LLP

(57) ABSTRACT

Method of producing a shell-proof and bullet-proof structure comprising a first internal layer having a high resistance against the impact of a shell or a bullet, and at least a second external pierceable layer having a relatively low melting temperature allowing it to melt when hit by the shell or bullet for retaining the latter and avoiding the rebound thereof.

10 Claims, 9 Drawing Sheets

10
11
12
13
14
25

METHOD OF PRODUCING A SHELL-PROOF AND BULLET-PROOF STRUCTURE, AND SHELL-PROOF AND BULLET-PROOF STRUCTURE

CROSS-REFERENCE TO RELATED APPLICATIONS

This application is a 371 of PCT/IB2009/007281 filed Oct. 28, 2009, which claims the benefit of Italian Patent Application No. FI2008A000206 filed Oct. 29, 2008, the contents of each of which arc incorporated herein by reference.

TECHNICAL FIELD OF THE INVENTION

The present invention relates to a method for making shell-proof and bullet-proof structures both for self-protection, such as jackets, and for armor-plating, such as protective panels for transportation vehicles, buildings and combat means.

In particular, the method relates to the fabrication of a shell-proof and bullet-proof structure provided with a resistant internal layer and an external no-bounce case, for example of plastics such as polymers, elastomers and foam materials.

BACKGROUND OF THE INVENTION

This structure is known from the Application FIA2005210 in the name of the present inventor.

DETAILED DESCRIPTION

The object of the present invention is to achieve a shell-proof and bullet-proof structure having uniform characteristics and a high piercing-resistance/weigh ratio, able to withstand a repeated number of shots, even if concentrated in a limited area of the structure, without the structure being pierced and, in any case, without causing excessive traumas to the user as a consequence of the deformation of the structure on the side opposite to that of arrival of the shell or bullet and usually in contact with the user's body (for example, in case of shell-proof jackets).

A further object is to achieve a shell-proof and bullet-proof structure being resistant with the passing of time to weather agents, sudden changes of temperatures and aggressive environments.

Yet another object is to be able to produce shaped structures to make protective panels having high strength for armoring vehicle and aircrafts.

The characteristics and advantages of the present invention will appear more clearly from the indicative and thus non-limiting description of a preferred but non-exclusive embodiment of the invention as illustrated in the accompanying drawings, wherein:

FIGS. 1 and 1*a*-1*b* are, respectively, an elevation view, a top view and a right side view of a plate making up the resistant layer of a shell-proof and bullet-proof structure according to the invention;

FIGS. 2 and 2*a*-2*b* are, respectively, an elevation view, a top view and a right side view of a plate making up the resistant layer of a shell-proof and bullet-proof structure according to a second embodiment of the invention;

FIGS. 3*a*, 3*b*, 3*c* are, respectively, elevation views of the front half-impression and rear half-impression, and a cross-section view of a first mold for making an intermediate assembly of a shell-proof and bullet-proof structure according to the invention;

FIGS. 4*a*, 4*b*, 4*c* are, respectively, elevation views of the front half-impression and rear half-impression, and a cross-section view of a second mold for making an intermediate assembly of a shell-proof and bullet-proof structure according to the invention;

FIGS. 5*a*-5*b* are, respectively, an elevation view and a cross-section view of a shell-proof and bullet-proof structure according to the invention;

FIGS. 6*a*-6*b* are, respectively, an elevation view and a cross-section view of a shell-proof and bullet-proof structure according to a second embodiment of the invention;

Figure 1A:
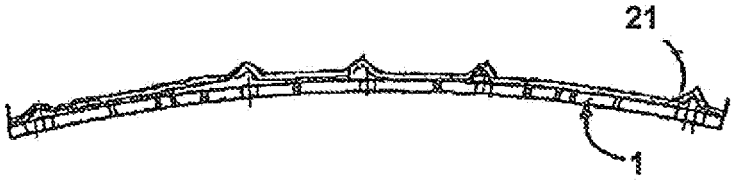
Figure 1:
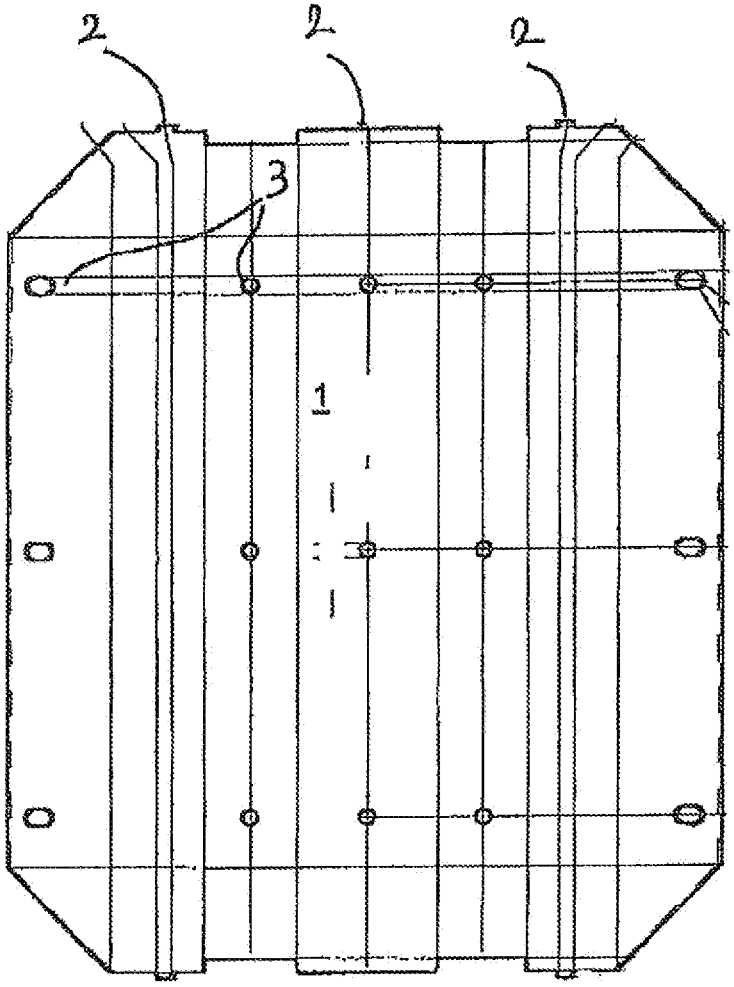
Figure 1B:
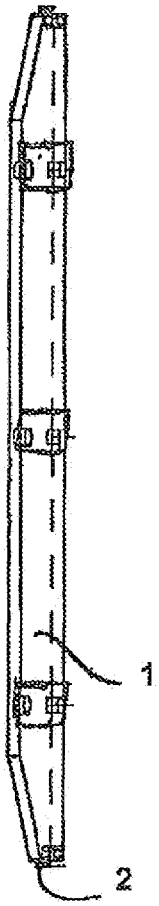
Figure 2A:
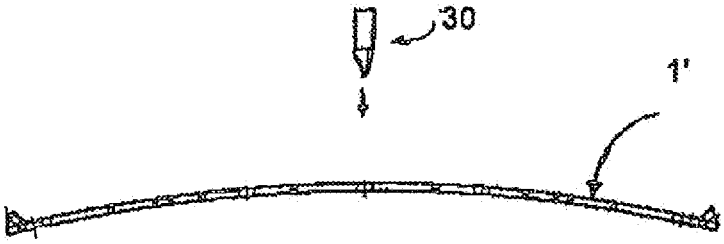
Figure 2:
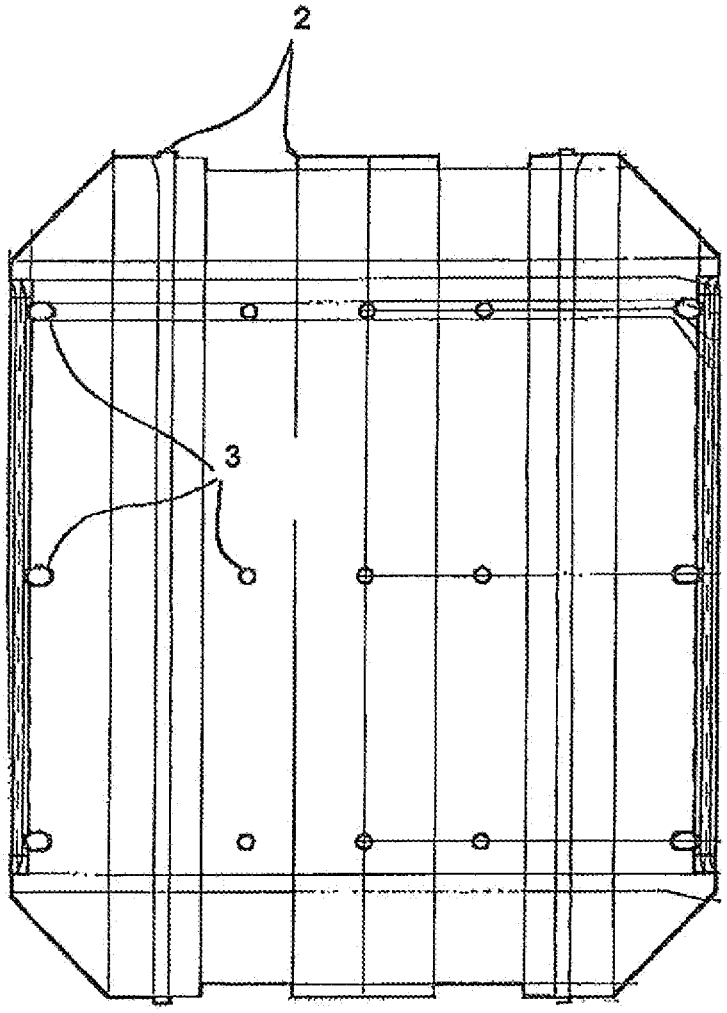
Figure 2B:
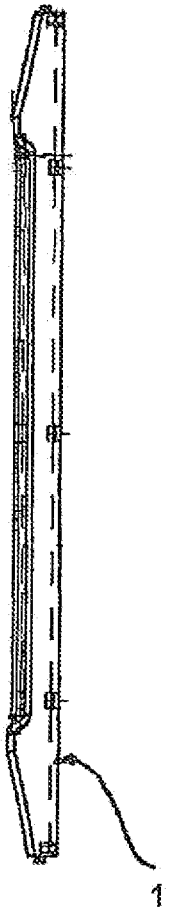
Figure 3C:
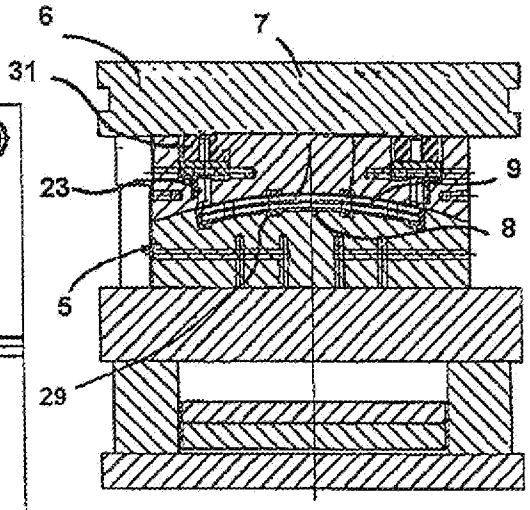
Figure 3B:
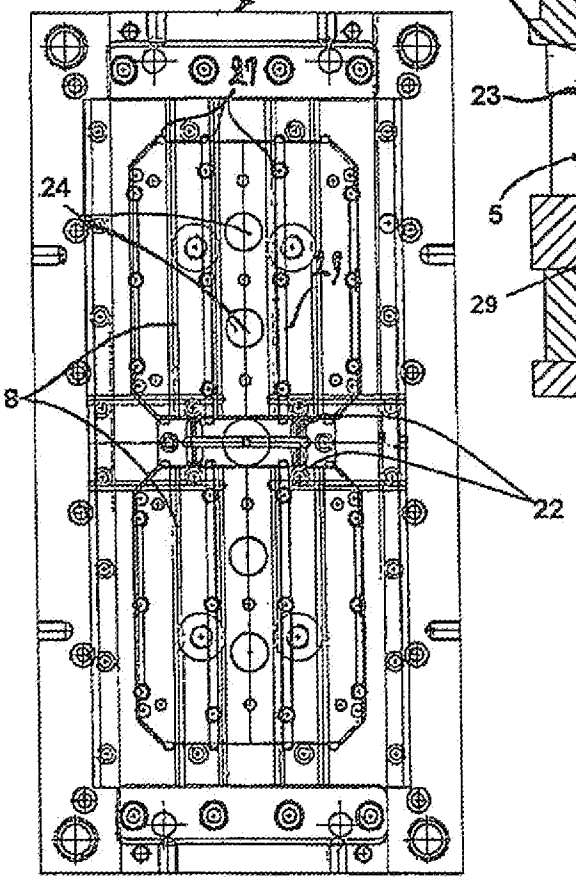
Figure 3A:
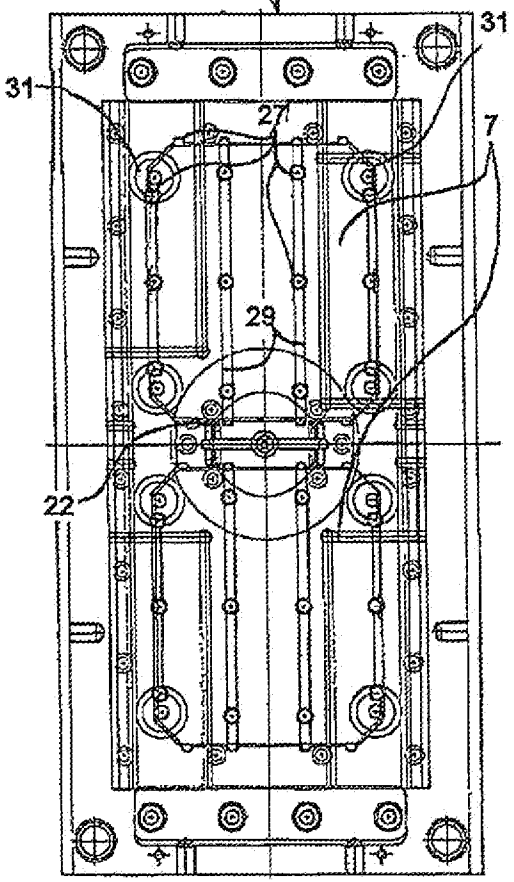
Figures 4A, 4B, 4C:
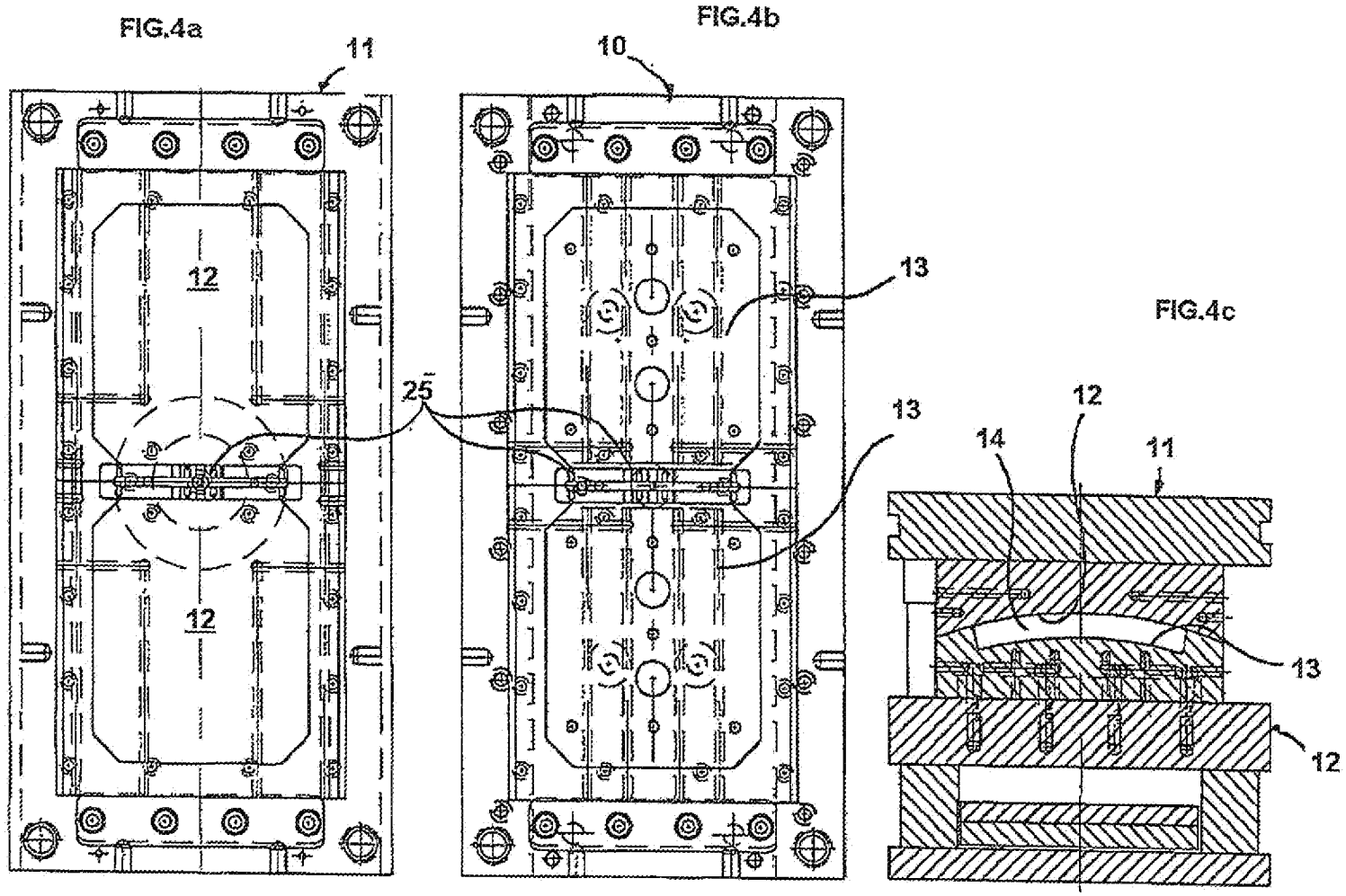
Figure 5A:
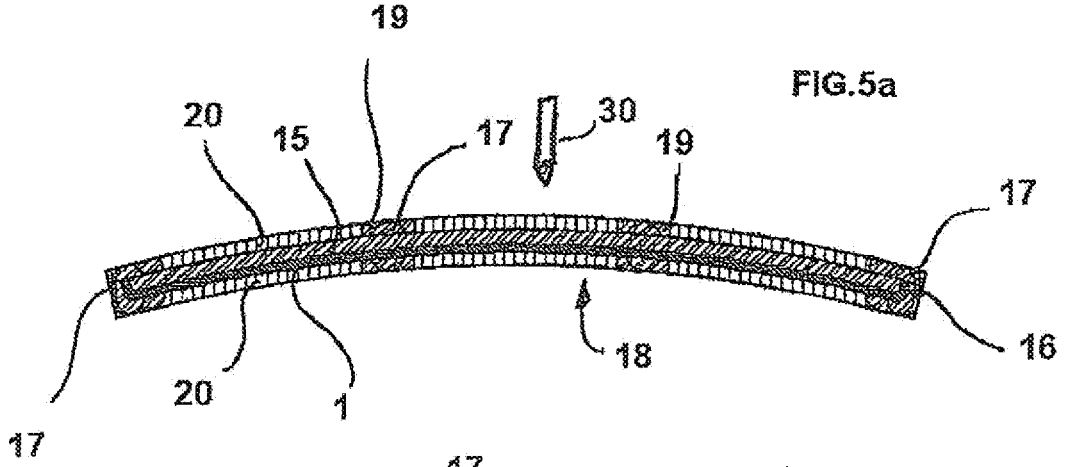
Figure 5:
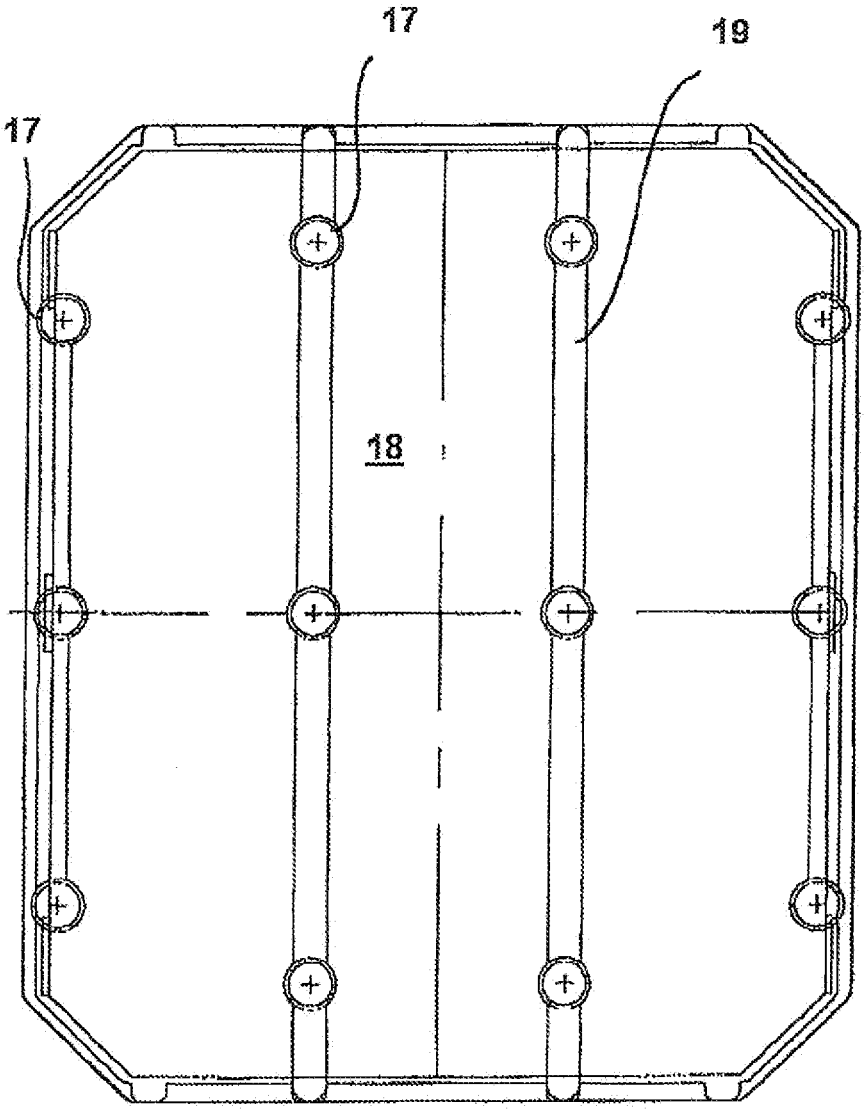

Described herebelow with reference to the accompanying drawings is a shell-proof and bullet-proof structure comprising an internal resistant layer and an external no-bounce case 20.

In the preferred embodiment, the resistant layer comprises a plate 1 made of steel, preferably heat-treated steel molded in a shape which is convex towards the impact face of the shell or bullet 30 and preferably stiffened, at least on the same face, by cross-pieces of reinforcement rings 21.

The method includes the steps of disposing the plate 1 in a first molding seat 9 defined by two half-impressions 7 and 8 formed in the half-sections 6, 5 of a mold for die-casting, and maintaining the plate at a predetermined distance, at least form the wall of the rear half-impression 7, in order to create an interspace between plate 1 and impression 7 in correspondence of the shell or bullet-impact face.

Preferably, the machine for carrying out the molding is of the type with toggle or scissors-type closure and an indicative closing thrust ranging from 500 to 3000 tons, depending on the dimensions and resistance of the final product.

Moreover, the mold being used is preferably of dual-impression type with two half-impressions 7, 8.

Preferably, the plate 1 is kept in position by magnets 24, disposed for attracting the plate into contact with the rear half-impression 5, and possibly by punches 23 located at the corners of the front impression 7 and able to push the plate 1 being inserted against the action of springs 31 consisting, for example, of a block of elastomeric material.

Preferably, one or both the half-impressions 7, 8 exhibit an array of voids 27 located at the edges as well centrally at least on the rear side and being connected through channels 29 also formed in one or both the impressions 7, 8.

Once the plate 1 has been disposed into the half-impression 8, the two half-impressions close up by overlapping each other and creating the molding seat 9.

At this point, the co-molding step is started by the injection into said first seat 9 through nozzles 22 of a first thermoplastic material 15 which is introduced under pressure to fill up the interspace on the rear side of the plate, the voids 27 and channels 29.

Advantageously, the plate 1 may exhibit raised edges 2 which make it possible to define, with accuracy, the interspace to be filled with the termoplastic material 15.

Upon completion of the injection, an intermediate assembly 16 is obtained made up of the plate 1, the layer of thermoplastic material 15 disposed on the front side of the plate, and of projections 17, 19 distributed on one or both the faces of the assembly 16 and on the edges thereof, in correspondence of the impressions' voids 27, 29.

According to the method, the thermoplastic material being used is a heat-melting polymer charged with a piercing-resisting additive, for example glass fibers, metal fibers or others, and possibly talc.

It will be appreciated that other additives may be used to improve the resistance to piercing.

Preferably, the injection is carried out in a mold by pressure die-casting at a temperature ranging from about 240 and 280° C. and a pressure P1 in the injection chamber between approximately 45 and 70 bar.

Once the intermediate assembly 16 is obtained, the half-impressions can be opened and the intermediate assembly 16 can be inserted into a second molding seat 14 made up of two front and rear half-impressions 12, 13 formed in the half-cases 11, 10 of a mold by pressure die-casting.

Owing to the presence of the projections 17, 19, the assembly 16 is kept at a predetermined distance from the walls of the half-impressions 12, 13 thereby creating an interspace that encircles substantially the whole intermediate assembly.

Once the half-impressions 12, 13 has been closed, the method provides for injecting a second thermoplastic material into said second seat 14 through nozzles 25, until the coupling of the intermediate assembly with the second casting of thermoplastic material is obtained.

Upon completion of injection, a structure is obtained 18 comprising a resistant intermediate assembly 16 fully wrapped up by a case of thermoplastic material 20.

Figure 6:
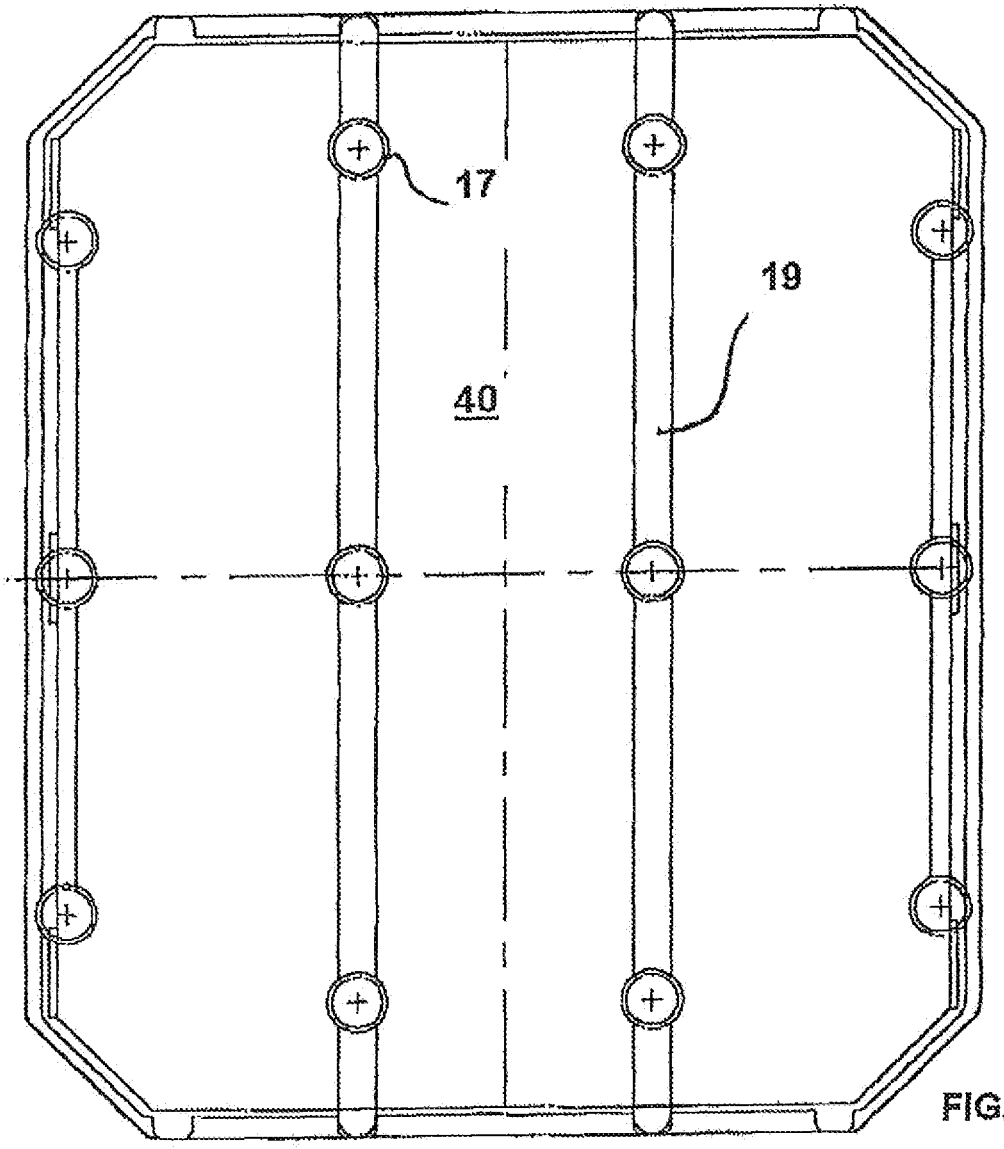
Figure 6A:
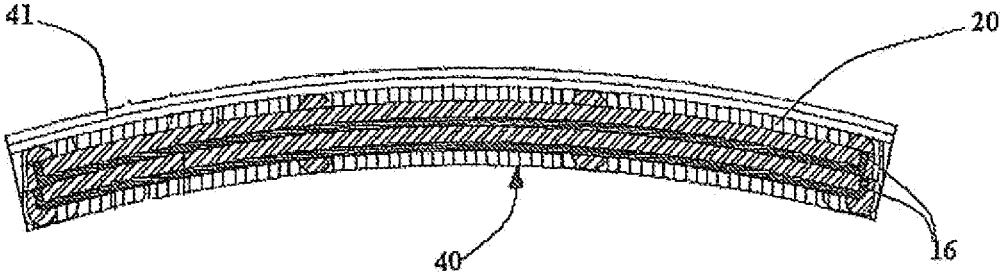

In a preferred embodiment, the second injection seat is disposed for collecting two or more intermediate assemblies (FIG. 6) to create a structure 40 even more resistant., Advantageously, when the structure is used for armoring the body of vehicles is also possible to apply an outer layer of aluminum 41 (FIG. 6*a*) which is useful both for improving strength and completing the shaping of the body.

Figure 8:
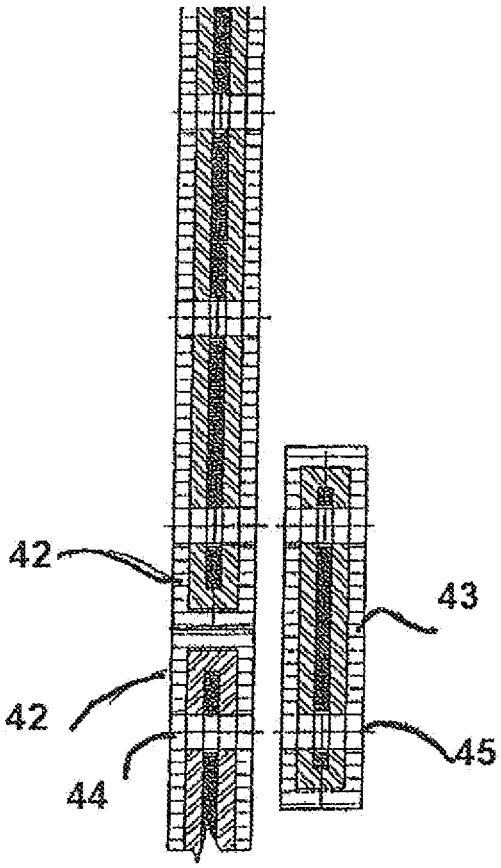
FIG. 8 shows an example of structure, according to the invention, in the form of panels for armoring buildings.

Schematically shown in FIG. 8 is a possible disposition of armoring panels 42 (for example for application to buildings) obtained by a structure according to the invention.

Advantageously, the panels 42 are provide with holes 44 for screws or bolts to go through and intended to fasten second overlapping panels 43 to increase the resistance in the points of contact between adjacent panels 42.

Figure 9:
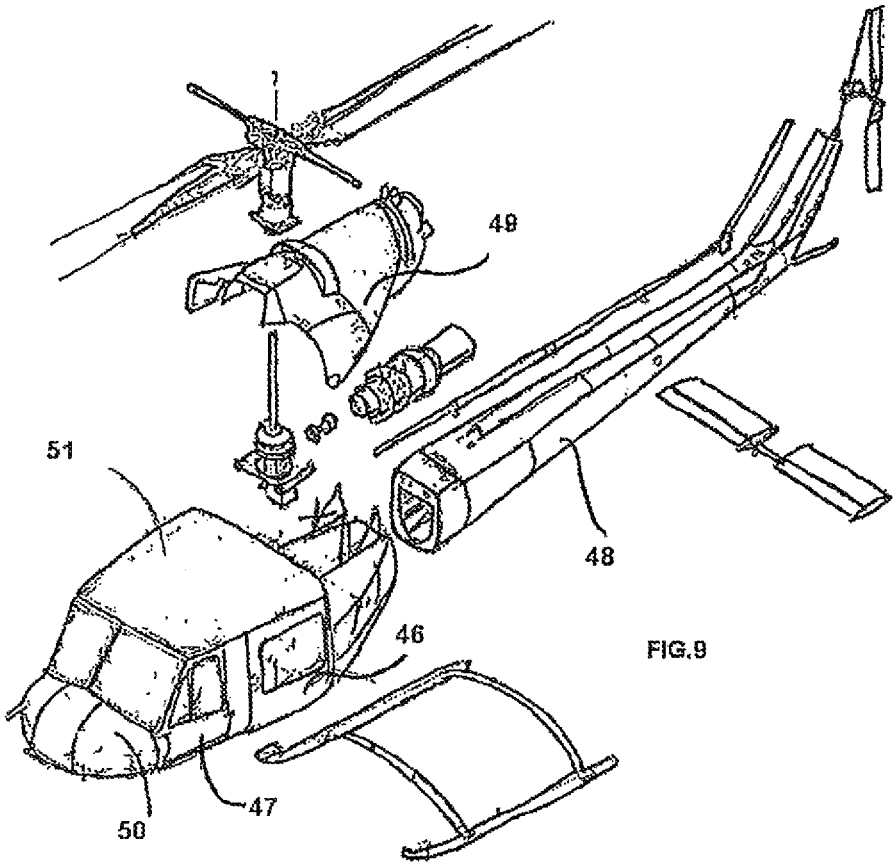
FIGS. 9 and 10 show an example of structure according to the invention in the form of parts of a helicopter and an aeroplane, respectively.
Figure 10:
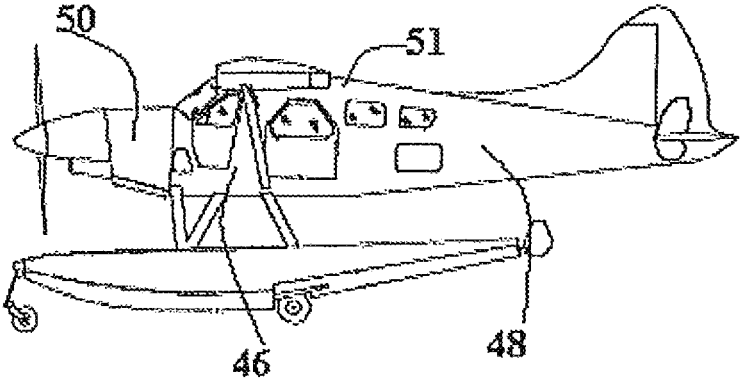

Schematically represented in FIGS. 9 and 10 are, respectively, a helicopter and an aeroplane with some body portions shown in exploded view (46-side door, 47-cabin bottom, 48-tail, 51-top cover, 50-front portion) and which make up an exemplary list of parts of an aircraft body that can be armored by a structure according to the invention.

Figure 11:
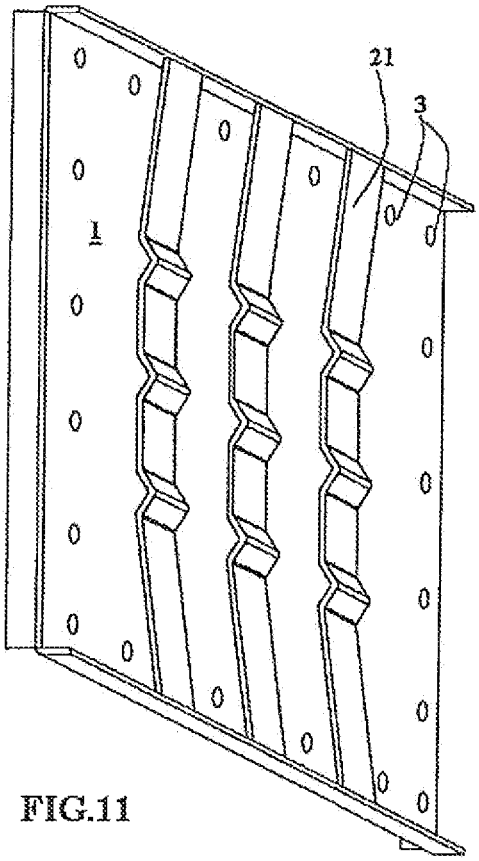
FIGS. 11 and 12 show respectively a further embodiment of the structure according to the invention in a perspective view and cross-section view.
Figure 12:
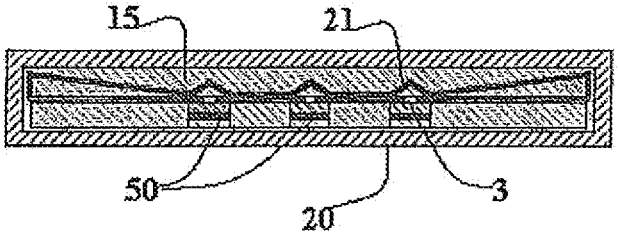

Shown in FIGS. 11 and 12 is a preferred embodiment of the structure wherein provision is made for an array of stiffening cross-pieces 50 joined to the plate 1 by welding, for example, on the opposite side of the reinforcement rings 21 and orthogonal thereto.

According to the method, the thermoplastic material is a heat-melting polymer charged with a no-bounce additive such as rubber, for example.

It will be appreciated that other additives may be used to improve the capacity of incorporating a shell or a bullet and preventing the rebound thereof.

Moreover, it is possible to use self-extinguish or flame-retardant materials.

Preferably, the thermoplastic materials being used for the two injections comprise the same or similar matrix (for example, matrixes of the same polymer) to increase the resistance of the interface.

Preferably, the second injection is performed within a mold for pressure die-casting at a temperature T2 lower than T1 and ranging approximately between 240 and 270° C. and with a pressure. P2 in the injection chamber lower than P1 and ranging approximately between 32 and 50 bar.

With this choice of temperature pressure conditions for the second injection, there is obtained, advantageously, an optimal adhesion to the interface between the two layers of thermoplastic material being injected and heat-melted in succession without, however, reducing the quality of the first injected layer.

A first advantage is the capacity of the structure thus obtained to absorb impacts of shells or bullets fired close to each other in succession, without the limits usually imposed by resistance-to-impact tests which provide, for example, in case of vests made of kevlar, that the shots be not into alignment along the fibres but distributed instead according to a fire template or, in case of vests made of dynema or ceramic, that the shots be in compliance with a fire template.

Actually, the tests being performed, have shown that with the structure according to the invention no piercing occurs substantially, whatever the distribution of shots, and the traumas are extremely limited (from 0 to 5 millimeters).

Also verified has been the fact that, with the structure according to the invention, the shells or bullets that hit the structure 18 enter the thermoplastic anti-bounce layer and thermoplastic resistant layer 15, and the lead charge of the shell or bullet tend to spread within the interface between the plate 1 and the first thermoplastic layer.

In this way, no so-called "mushroom" is formed by the shell or bullet which, on the contrary, deforms the resistant part by releasing all the kinetic energy at the point of impact and avoid the occurrence of a trauma, that is, a deformation of the structure on the rear side in contact with the user's body.

Moreover, it has been verified that the structure of the invention is able to absorb the impact due to the explosion of a grenade (the tested grenade being of 40 mm) and to retain the splinters produced by the explosion.

A second advantage is the resistance in the passing time to weather and chemical agents.

It has been releaved, in fact, that the structure thus obtained maintains its anti-piercing capacity also after forced aging treatments in hydrosaline mist and after repeated thermal cycles at temperatures ranging from +65 to −33° C.

A third advantage is the possibility of molding shaped structures for armoring vehicles or watercrafts, for example structures produced in the form of vehicle bodywork parts, such as doors, bottom, roof panels, seats or others.

A fourth advantage is the possibility of creating structures shaped for armoring buildings or parts thereof by easily obtaining a full covering of the part to be protected.

A further advantage lies in the fact that the structure results self-bearing, that is, it does not need further supports such as, for example, protective structures in Kevlar® and the like to be used for the production of structural parts like vehicle's bodywork parts or others. Yet another advantage is the possibility that the invention offers of producing containment boxes of a type used for unloading and loading fire arms and transporting explosive materials or contaminating chemicals in safe conditions.

By way of example only, a structure according to the invention can be used for making armored gun-hoisters. This aspect is very important inasmuch as it avoids the possibility of accidental escape of a shell or bullet from the gun hoister.

A further possible application of the present invention can be that of producing footwear or armored parts thereof. Yet another advantage is the possibility that the invention offers of producing armored helmets 28, made up of one or more pieces, or armored visors 26 for use by blasters, for example.

Figure 7:
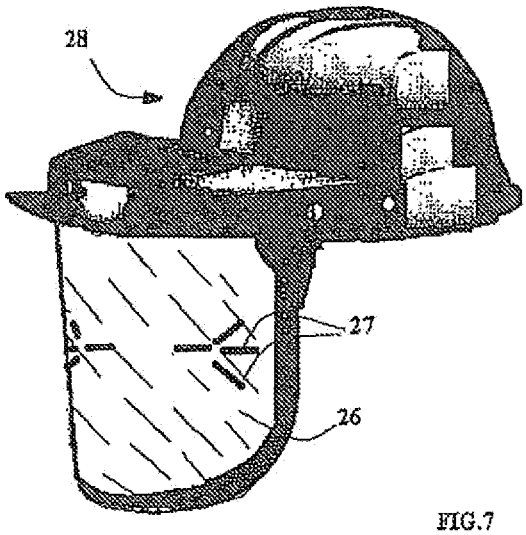
FIG. 7 shows schematically a visor for blasters, according to the invention.

In the latter case, the visor 26, shown schematically in FIG. 7, is made up of a visor-shaped structure according to the invention and provided with slits 27 allowing the operator to see through but preventing the passage of splinters in case of explosion.

According to a further aspect of the invention, the shell-proof and bullet-proof structure may comprise a resistant layer, for example a plate of the type above described, which is coated (preferably after a step of surface cleaning) with a layer of primer solution and then with one or more no-bounce layers of polymeric material.

By this solution, the polymeric layer adhers to the resistant layer by the action of the primer solution being used, and can be poured into the mold instead of being introduced therein by pressure.

Figure 13:
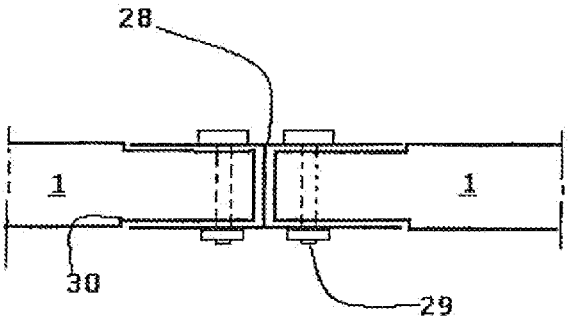

According to yet another aspect of the invention, and as schematically illustrated in FIG. 13, the structures 1 can be assembled by means of dual "C"-joints 28 to which the two structures 1 can be fixed by screws 29.

Preferably, the structures 1 exhibit a diversified thickness 30 in correspondence of the joints-overlapping region so as to provide a uniform external thickness.

In this embodiment, the structures 1 are especially useful in the formation of panellings for armoring vehicles or walls.

The invention thus conceived can also be the object of several modifications and variants, all falling within the scope of the inventive idea; moreover, all the parts can be replaced with technically equivalent elements.

The invention claimed is:

1. Method of producing a shell-proof and bullet-proof structure comprising an internal resistant layer and an external no-bounce case, the method comprising the steps of:

arranging the resistant layer in a first molding seat for pressure die-casting, and maintaining the resistant layer at a predetermined distance from at least one wall of the first molding seat, to create an interspace corresponding at least to an impact face of a shell or bullet;

injecting a first thermoplastic material at temperature T1 and pressure P1 in said first molding seat, said first thermoplastic material comprising a polymeric matrix charged with at least a resistant additive, to obtain a coupling of the resistant layer with a first cast of thermoplastic material in an intermediate assembly;

arranging the intermediate assembly consisting of said resistant layer and first cast in a second molding seat of a mold for pressure die-casting, and maintaining said intermediate assembly at a predetermined distance from at least one wall of the second molding seat to create an interspace substantially enclosing the intermediate assembly; and injecting a second thermoplastic material at a temperature T2 and pressure P2 in said second molding seat, said second thermoplastic material comprising a polymeric matrix, to obtain a coupling of the intermediate assembly with a second cast of thermoplastic material.

2. Method according to claim 1, wherein said resistant layer comprises a concave shaped steel plate with reinforcement ring.

3. Method according to claim 1, wherein said first and second thermoplastic material comprise a polymeric matrix to improve the adhesion of said first and second casts.

4. Method according to claim 1, wherein said temperature T1 is between 240 and 280° C.

5. Method according to claim 1, wherein said temperature T2 is lower than said temperature T1.

6. Method according to claim 1, wherein said pressure P1 is between 45 and 70 bar.

7. Method according to claim 1, wherein said pressure P2 is lower than said pressure P1.

8. Method according to claim 1, wherein said step of maintaining the resistant layer at a predetermined distance from the at least one wall of the first molding seat is carried out by interposing spacer elements.

9. Method according to claim 1, wherein said step of maintaining the intermediate assembly at a predetermined distance from the at least one wall of the second molding seat is carried out by means of spacer elements created on said intermediate assembly during said step of injecting said first thermoplastic material in said first molding seat.

10. Method according to claim 1, wherein at least one of said first and said second molding seats is a dual-seat impression.

* * * * *